US005146982A

United States Patent [19]

Dinkins

[11] Patent Number: 5,146,982

[45] **Date of Patent: * Sep. 15, 1992**

[54] COIL TUBING ELECTRICAL CABLE FOR WELL PUMPING SYSTEM

[75] Inventor: Walter R. Dinkins, Lawrence, Kans.

[73] Assignee: Camco International Inc., Houston, Tex.

[ * ] Notice: The portion of the term of this patent subsequent to Sep. 8, 2009 has been disclaimed.

[21] Appl. No.: 676,994

[22] Filed: Mar. 28, 1991

[51] Int. Cl.[5] ..... E21B 23/00

[52] U.S. Cl. ..... 166/65.1; 174/47

[58] Field of Search ..... 166/65.1, 68, 68.5, 166/77; 174/47, 100

[56] References Cited

U.S. PATENT DOCUMENTS

| | | | |
|---|---|---|---|
| 2,798,435 | 7/1957 | Armstrong | 103/5 |
| 3,889,579 | 6/1975 | Wiechowski et al. | 92/3 |
| 4,262,703 | 4/1981 | Moore et al. | 138/115 |
| 4,346,256 | 8/1982 | Hubbard et al. | 174/47 |
| 4,476,923 | 10/1984 | Walling | 166/65 |
| 4,569,392 | 2/1986 | Peterman | 166/242 |
| 4,570,705 | 2/1986 | Walling | 166/77 |
| 4,572,299 | 2/1986 | Vanegmond et al. | 166/385 |
| 4,607,693 | 8/1986 | Richardson | 174/47 X |
| 4,644,094 | 2/1987 | Hoffman | 174/47 |
| 4,665,281 | 5/1987 | Kamis | 174/102 |
| 4,681,169 | 7/1987 | Brookbank, III | 166/385 |
| 4,718,486 | 1/1988 | Black | 166/68 |
| 4,726,314 | 2/1988 | Ayers | 114/243 |
| 4,743,175 | 5/1988 | Gilmore | 417/361 |
| 4,830,113 | 5/1989 | Geyer | 166/369 |

OTHER PUBLICATIONS

Sandia Report, SAND82-0425, Feb. 1982, entitled "Proceedings-High Temperature Electronics and Instrumentation Conference-Dec. 1981".

*Primary Examiner*—William P. Neuder
*Attorney, Agent, or Firm*—Fulbright & Jaworski

[57] ABSTRACT

A coil tubing electrical power cable system for use with a submersible pump in oil well and/or water well pumping applications. The cable includes a plurality of insulated electrical conductors enclosed in a low tensile strength corrosion-resistant metal tubing. The twist factor or lay length of the conductors is approximately eight to fourteen times the diameter of the insulated conductors in order to overcome the tensile loads and elevated temperatures which cause z-kinking. In addition, the electrical cable may include one or more hydraulic tubes.

6 Claims, 2 Drawing Sheets

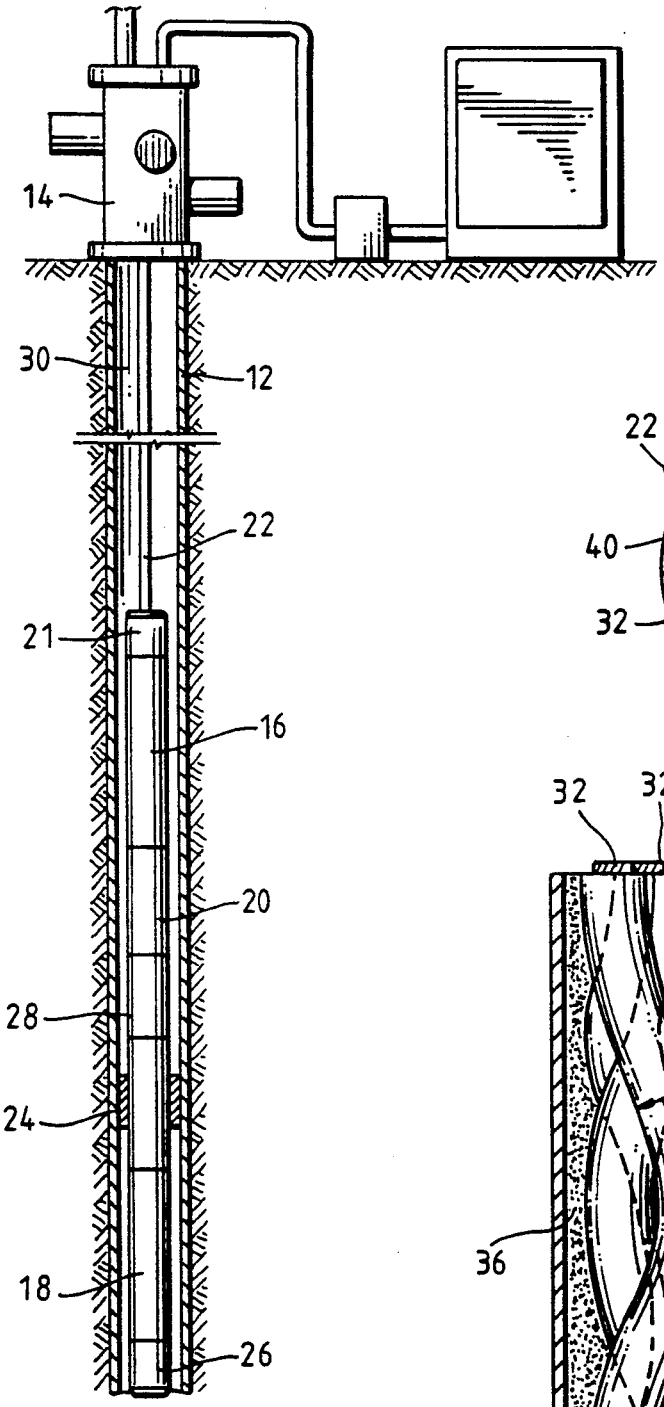
FIG.1
FIG.2
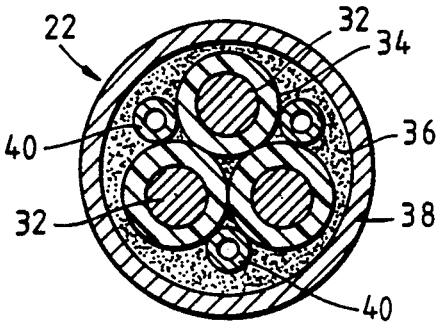
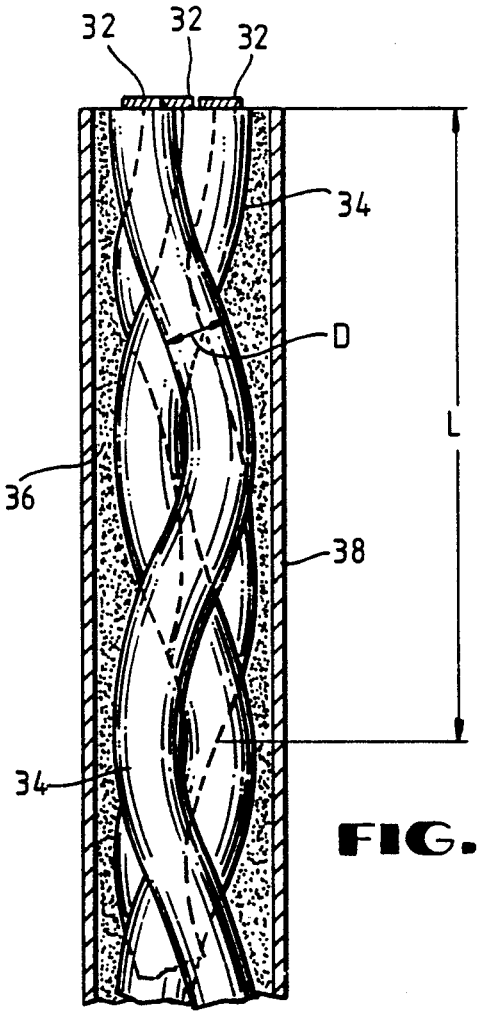
FIG.3

FIG.4
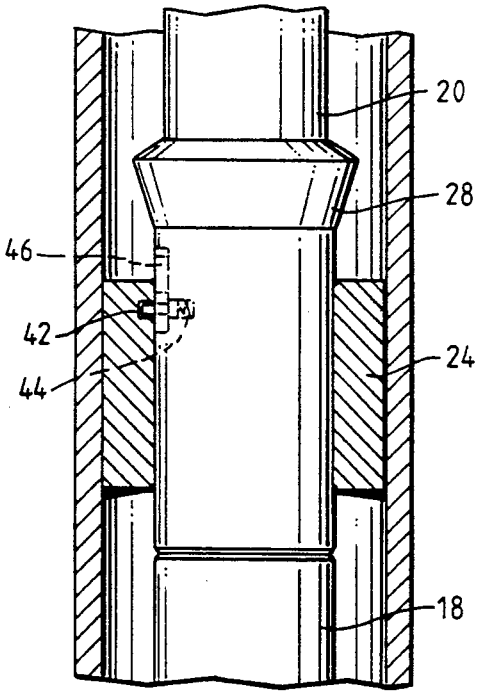
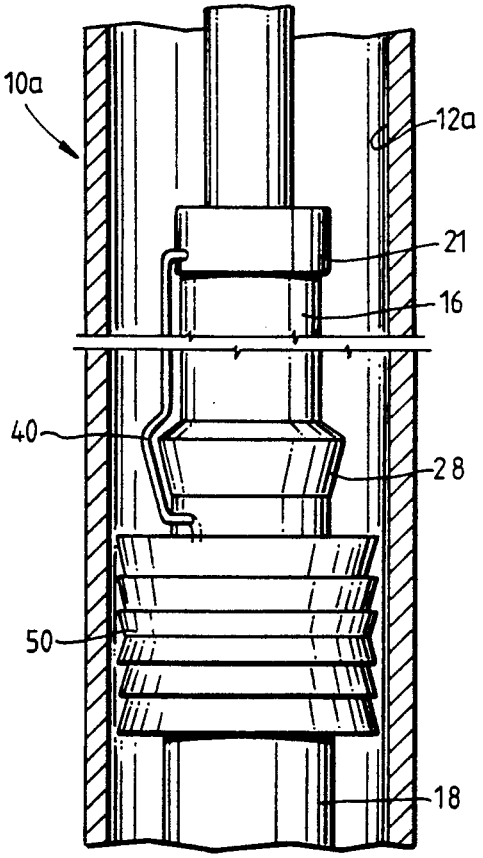
FIG.5

COIL TUBING ELECTRICAL CABLE FOR WELL PUMPING SYSTEM

BACKGROUND OF THE INVENTION

It is known to utilize an electrical cable to supply electrical energy to a downhole motor which drives a pump for producing oil or water from a well. In addition, U.S. Pat. Nos. 4,346,256 and 4,665,281 disclose the use of insulated electrical conductors enclosed in a metallic tube for supplying electrical power to a well pump.

However, the prior art has not recognized or has been directed to the effect that tensile loads and high temperatures will have on the relative motion of the inner electrical conductors to the outer metallic tube. Insulation and jacket materials allow higher modulus materials, such as copper or aluminum, to easily elongate or even yield the insulation, such as elastomers. This condition is exacerbated over the longer lengths typically encountered in water and oilwells. The primary failure mechanism in electromechanical well cables is conductor "z-kinking" whereby the electrical conductors will twist radially leading to electrical failure. Another term for z-kinking is called birdcaging and is defined as the permanent deflection of a wire rope forced into compression. The cause of z-kinking in electromechanical cables exposed to tensile and compressive forces and elevated temperatures stem from the high coefficient of thermal expansion of the electrical conductors (typically copper or aluminum) versus the tensile supporting member (typically steel) which leads to compressive loading of the conductors.

The present invention is directed to a solution to this problem by controlling the elongation of the metal components of the electrical cable to allow optimum performance under tensile load and at elevated temperatures.

SUMMARY

The present invention is directed to an electrical motor operated well pump system for use in a well which includes an electrical cable adapted to be connected to the motor. The cable includes a plurality of insulated electrical conductors enclosed in a low tensile strength corrosion-resistant metal tubing. The twist factor or lay length of the conductors is approximately eight to fourteen times the diameter of the insulated conductors in order to minimize the tendency for the conductors to Z-kink. Preferably, the lay length is approximately ten times the diameter of the insulated conductors.

Still a further object of the present invention is wherein the electrical cable includes one or more hydraulic tubes extending through the cable interiorly of the metal tubing for control of other well equipment.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 1 is an elevational schematic view of a submersible pumping system using the present invention, FIG. 2 is an enlarged, cross-sectional view of the electrical cable connected to the motor and the pump of FIG. 1, FIG. 3 is a cut-away elevational view, partly in cross section, illustrating the twist or lay length of the electrical conductor of FIG. 2, FIG. 4 is a fragmentary elevational view, partly schematic, illustrating the connection of the motor and pump in the well, and FIG. 5 is an enlarged fragmentary elevational view of another method for setting the motor and pump in a well.

DESCRIPTION OF THE PREFERRED EMBODIMENT

Referring now to the drawings, and particularly to FIG. 1, the reference numeral 10 generally indicates a submersible well pumping system of the present invention which is to be installed in a well casing 12 beneath a wellhead 14. The system is installed in the casing 12 and generally includes an electrical motor 16 which supplies rotational energy for a downhole pump 18. A motor protector 20 helps to isolate the motor 16 from mechanical vibrations and well fluids. A motor connector 21 provides a connection between the motor 16 and an electrical supply. The pumping system 10 is lowered into the well casing 12 using an electrical cable 22 and attaches to the motor connector 21. The pumping system 10 is lowered until reaching a prepositioned shoe 24 which is positioned in the casing 12 and the pumping system 10 is latched into the shoe 24. The shoe 24 also serves to separate the pump intake 26 and the pump discharge 28 sections. Produced well fluid is pumped up the annulus 30 to the wellhead 14. Generally, the above description of a well pumping system is known.

Referring now to FIG. 2, the preferred embodiment of the electrical cable 22 is best seen and is comprised of a plurality of electrical conductors 32, preferably copper, although aluminum is satisfactory. The electrical conductors 32 are preferably of a stranded wire to allow flexibility when twisting two or more of the insulated conductors together.

The electrical conductors 32 are surrounded by a primary insulation 34 and the conductors 32 and insulation 34 are enclosed within a jacket 36 which serves to protect the insulated conductors during manufacture and enclosing within an outer metallic tube 38. In one embodiment, the insulation 34 may be ethylene propylene compound designed for operating in temperatures up to 400° F. In this embodiment, the jacket material 38 is also an ethylene propylene compound with a 400° F. rating. In another embodiment, the insulation 34 may be of propylene thermoplastic and the jacket 36 may be of a high density polyethylene. This second embodiment may be used in shallow wells with low bottom hole temperatures. In still a further embodiment, the insulation 34 may be of polyetheretherketone thermoplastic and the jacket 36 is of fluorinated elastomer such as sold under the trademark "Aflas." This third embodiment construction is useful in wells with high bottom hole temperatures.

The outer metallic tube 38 is preferably made of a standard low tensile strength, low alloy steel, such as ASTM A606, which is welded inline with the electrical power conductors 32, their insulation 34 and swedged over the core jacket 36 for a mechanical grip and to prevent well gases from migrating up the cable core. The forming of the metallic tube 38 is done in two separate sections: preforming a C-shape in a first section allowing placement of the cable core, and a second forming section is used to close the circle for welding. A low heat welding technique such as TIG welding is used to minimize damage to the jacket 36 material. Preferably, the strength of the outer metal tube 38 will support its own weight, the cable core weight consisting of the conductors 32, insulation 34, and jacket 36, as well as the pump system of the motor 16 and pump 18 and connected equipment up to practical oilwell depths. The yield strength of the outer metal tube 38 will provide an adequate safety margin to allow for corrosion and added strength to release the well pumping system 10 during retrieval. While, of course, high tensile strength metallic tubing 38 could be used, it is generally not preferred, as it is less corrosion resistant. And, of course, if because of an extremely deep well, the strength of the outer metal tube 38 is not sufficient, additional support members (not shown) can be connected to the motor and pump assembly for support.

As shown in FIG. 2, if desired, one or more stainless steel hydraulic tubes 40 may be used extending through the interior of the cable 22 interiorly of the metal tubing 38 to provide hydraulic control of other well equipment, as will be discussed more fully hereinafter, or to provide a well treatment capability. However, the hydraulic tubes 40 may be omitted if not needed.

However, as indicated while coil tubing electrical cable systems have been proposed in the past, they have not been directed to the problem of how to overcome the effects of tensile loads and high temperatures on the relative motion of the inner conductors 32 relative to the outer metallic tube 38. The primary failure mechanism in electrical cables such as cable 22 has been z-kinking of the electrical conductors 32 because of high elongation when the electromechanical cable 22 is under tension followed by compression due to higher thermal expansion of the conductors 32 (and higher temperature due to resistant heating) compared to the metallic tube 38. For example, the coefficient of thermal expansion of copper is 16.E-6 in/in/deg. C., of aluminum is 23.E-6 in/in/deg. C., and of steel is 12-E in/in/-deg. C. Thus, the conductors 32 of either copper or aluminum will tend to kink or loop on itself at intervals along the cable 22 during increased temperature changes which results in cable failure.

The present invention is directed to overcome the problem of tensile load and elevated temperatures. Specifically, the difference in elongation of the two metal components, the electrical conductors 32 and the metallic coil tube 38 are closely designed to allow optimum performance. The elongation of the coil tube 38 may be controlled with the wall thickness used. Design constraints for the outer metallic tube 38 include: core weight, coil tube material weight, submersible pumping unit weight, and maximum operating temperature. Design constraints for the cable core include: maximum cable elongation, conductor size, insulated conductor twist factor and maximum operating temperature. The elongation of the electrical conductors 32 is maintained below the materials ultimate yield at the cable maximum load by varying the twist factor or twist lay length which is the length for one of the conductors to twist one revolution or 360°. In the present invention, to minimize the tendency of the electrical conductors 32 to Z-kink, the twist lay length has been reduced to allow the conductors 32 to act more as a spring when subjected to tensile and compressive forces encountered in normal operation. In the present invention, it has been calculated that the lay length L (FIG. 3) should be eight to fourteen times the diameter D of an insulated conductor 32. Preferably, the lay length is ten times the insulated conductor diameter. The effect of reducing the lay length L of the conductors 32 in effect increases the overall length of the conductors 32 and makes the difference in the coefficient of thermal expansion between the conductors 32 and the coil tubing 38 less significant. Because lay angle of conductors is at higher angle to axis of cable, the tensile and compressive forces are expressed in the elastomer core (as a spring) rather than in forcing the conductors to deform radially (forming z-kinks when compressed).

As an example only, the following parameters have been calculated to provide a satisfactory system in a well in which the pumping unit 10 has been installed at a depth of 6500 feet and the weight of the pumping unit is 3200 pounds at a maximum operating temperature of 400 F. For example, the metallic coil tube 38 had a wall thickness of 0.080 inches, the core weight was 1.23 lbs/ft, and the coil tube 38 material weight was 0.99 lbs/ft. For copper twisted conductors 32 of a size #1 ANG, the maximum cable elongation was 0.20%, with an insulated copper twist factor of 10.

To retrieve the submersible pumping system 10, the preferred release mechanism, as best seen in FIG. 4, is by use of one or more calibrated shear pins 42 which are set to break at an adequate level below that of the outer metal tube 38 yield strength. A shear pin 42 is set into the shoe 24 by a spring 44 following removal of a pin cover 46 which is slidably moved out of engagement with the shear pin 42 when the cover 46 comes in contact with the shoe 24. Of course, other and different release mechanisms can be utilized.

Referring now to FIG. 5, another embodiment is shown in which the pumping unit **10*a* is set in a well in a casing 12*a* without requiring the use of the conventional shoe. In this case, a hydraulically set well packer 50, which may be actuated by one or more of the hydraulic lines 40 is connected to the pumping system 10*a*. Actuation of the packer 50 into engagement with the casing 12*a* provides ease in setting and releasing the pumping unit 10*a* from the casing 12*a***.

The present invention, therefore, is well adapted to carry out the objects and attain the ends and advantages mentioned as well as others inherent therein. While presently preferred embodiments of the invention have been given for the purpose of disclosure, numerous changes in the details of construction, and arrangement of parts, will be readily apparent to those skilled in the art and which are encompassed within the spirit of the invention and the scope of the appended claims.

What is claimed is:

1. An electrical motor operated well pumping system for use in a well comprising, an electrical cable adapted to be connected to the motor, said cable having a plurality of insulated electrical conductors having a diameter and which are twisted to have a lay length and which are enclosed in a low tensile strength corrosion-resistant metal tubing, and said lay length of the conductors is approximately eight to fourteen times the diameter of the insulated conductors.

2. The system of claim 1 wherein, said lay length is approximately ten times the diameter of the insulated conductors.

3. The system of claim 1 wherein the electrical cable includes, one or more hydraulic tubes extending through the cable interiorly of the metal tubing.

4. An electrical cable comprising, a cable having a plurality of insulated electrical conductors having a diameter and which are twisted to have a lay length and which are enclosed in a low tensile strength corrosion-resistant metal tubing, and said lay length of the conductors is approximately 8 to 14 times the diameter of the insulated conductors.

5. The cable of claim 4 wherein said lay length is approximately 10 times the diameter of the insulated conductors.

6. The cable of claim 4 wherein the electrical cable includes one or more hydraulic tubes extending through the cable interiorly of the metal tubing.

* * * * *